US008376170B1

(12) United States Patent
Lobdell

(10) Patent No.: US 8,376,170 B1
(45) Date of Patent: Feb. 19, 2013

(54) RECYCLE BIN COVER SYSTEM

(76) Inventor: Roy Jesse Lobdell, Freeville, NY (US)

( * ) Notice: Subject to any disclaimer, the term of this patent is extended or adjusted under 35 U.S.C. 154(b) by 307 days.

(21) Appl. No.: 12/852,496

(22) Filed: Aug. 8, 2010

(51) Int. Cl.
*B65D 25/28* (2006.01)
*B65D 6/40* (2006.01)
*B65D 1/42* (2006.01)
*B65D 6/34* (2006.01)

(52) U.S. Cl. ..... 220/212; 220/212.5; 220/601; 220/630; 220/651; 220/908

(58) Field of Classification Search ..... 220/212, 220/212.5, 315, 495.01, 495.06, 601, 630, 220/651, 908, 908.1
See application file for complete search history.

(56) References Cited

U.S. PATENT DOCUMENTS

| | | | | |
|---|---|---|---|---|
| D313,297 | S | 12/1990 | Carducci-Cosgrove et al. | |
| 5,098,250 | A | 3/1992 | Carson | |
| 5,131,552 | A | 7/1992 | Falso | |
| 5,160,060 | A | 11/1992 | Garofalo, Jr. | |
| D339,890 | S * | 9/1993 | Montgomery | D34/1 |
| 5,320,241 | A | 6/1994 | Evans | |
| 5,624,050 | A | 4/1997 | Haas | |
| 6,378,721 | B1 | 4/2002 | Williams | |
| D476,125 | S | 6/2003 | Chen | |
| 7,066,220 | B1 * | 6/2006 | Take et al. | 141/391 |
| 7,543,870 | B2 * | 6/2009 | Schwartz | 296/24.33 |
| 2005/0005516 | A1 * | 1/2005 | Schmidt | 47/65.5 |

* cited by examiner

*Primary Examiner* — Anthony Stashick
*Assistant Examiner* — Madison L Poos
(74) *Attorney, Agent, or Firm* — Kyle Fletcher

(57) ABSTRACT

The recycle bin cover system includes a top that has legs extending downwardly from beneath the cover and of which each leg has a cap, which screws onto to enclose the hollowed cavity of each leg that is used to fill with a weighty material for use in securing the cover atop a bin. The cover features a lip that secures the cover atop said bin. The bin may include leg receivers that are designed to further secure the legs and cover to the bin. The cover is designed to increase the overall volume of the bin and to prevent both the cover and the contents of the bin from blowing away during windy weather.

14 Claims, 5 Drawing Sheets

RECYCLE BIN COVER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of recycle bins, more specifically, a cover for use with a recycle bin.

B. Discussion of the Prior Art

As will be discussed immediately below, no prior art discloses a bin cover system comprising a top having legs extending therefrom; wherein each leg is of hollow construction having a cap that screws onto a bottom of each leg; wherein each leg is to be filled with heavy material such that the cover will stay secured a top of said bin in windy weather; wherein the cover has a lip that secures the cover to a top rim of said bin; wherein a main embodiment further includes leg receivers located at each corner of the bin to further secure said cover to said bin.

The Williams Patent (U.S. Pat. No. 6,378,721) discloses a compartmentalized recycling container having a lid. However, the lid or cover does not have legs that extend downwardly from under said lid and of which engage leg receivers located inwardly from within a bin.

The Haas Patent (U.S. Pat. No. 5,624,050) discloses a lid and structural arrangement for recycling and refuse receptacles. However, the structural arrangement fails to teach a lid having a plurality of legs extending from below said lid and of which slides within a bin to secure said lid atop said bin.

The Falso Patent (U.S. Pat. No. 5,131,552) discloses an outdoor recycling container having a hinged lid. However, the hinged lid does not have a plurality of legs that extend downwardly from beneath said lid and engage along an interior surface of a bin to secure said lid atop said bin in order to increase the overall volume of said bin and prevent the contents from blowing away in windy conditions.

The Carson Patent (U.S. Pat. No. 5,098,250) discloses a curbside container having a hinged lid. However, the hinged lid fails to teach legs extending downwardly from beneath said lid in order to add volume to a corresponding bin and of which aids in the securement of the lid atop said bin.

The Evans Patent (U.S. Pat. No. 5,320,241) discloses a bag holding system for a recycling container having a lid. However, the bag holding system does not teach a lid or cover that is supported by legs extending downwardly from underneath said cover to increase the volume of a corresponding bin.

The Garofalo, Jr. Patent (U.S. Pat. No. 5,160,060) discloses a method for locking a waste container in which the handles secure the container lid in place. However, the method fails to teach a lid having legs extending therefrom and of which engage along an interior surface of the corresponding bin in order to add volume of said bin, prevent items from blowing away in windy conditions, or secure said cover to said bin.

While the above-described devices fulfill their respective and particular objects and requirements, they do not describe a bin cover system comprising a top having legs extending therefrom; wherein each leg is of hollow construction having a cap that screws onto a bottom of each leg; wherein each leg is to be filled with heavy material such that the cover will stay secured a top of said bin in windy weather; wherein the cover has a lip that secures the cover to a top rim of said bin; wherein a main embodiment further includes leg receivers located at each corner of the bin to further secure said cover to said bin. In this regard, the recycle bin cover system departs from the conventional concepts and designs of the prior art.

SUMMARY OF THE INVENTION

The recycle bin cover system includes a top that has legs extending downwardly from beneath said cover and of which each leg has a cap, which screws onto to enclose the hollowed cavity of each leg that is used to fill with a weighty material for use in securing the cover atop a bin. The cover features a lip that secures the cover atop said bin. The bin may include leg receivers that are designed to further secure the legs and cover to the bin. The cover is designed to increase the overall volume of the bin and to prevent both the cover and the contents of the bin from blowing away during windy weather.

It is an object of the invention to provide a recycle bin cover system or any bin cover system wherein the volume of the bin is increased by a cover that extends vertically atop said bin.

A further object of the invention is to provide a cover that legs extending downwardly from underneath said cover and of which slides along an interior surface of said bin or slides down leg receivers formed along the interior of said bin, and to secure said top to the bin.

A further object of the invention is to provide legs of hollow construction such that a cap screws thereon to enclose a cavity that may be filled with weighted material to further secure said top to said bin.

A further object of the invention is to provide a cover that has a lip that locks onto an upper rim of said bin thereby securing said lid atop said bin.

These together with additional objects, features and advantages of the recycle bin cover system will be readily apparent to those of ordinary skill in the art upon reading the following detailed description of presently preferred, but nonetheless illustrative, embodiments of the recycle bin cover system when taken in conjunction with the accompanying drawings.

In this respect, before explaining the current embodiments of the recycle bin cover system in detail, it is to be understood that the recycle bin cover system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the recycle bin cover system.

It is therefore important that the claims be regarded as including such equivalent construction insofar as they do not depart from the spirit and scope of the recycle bin cover system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1A:
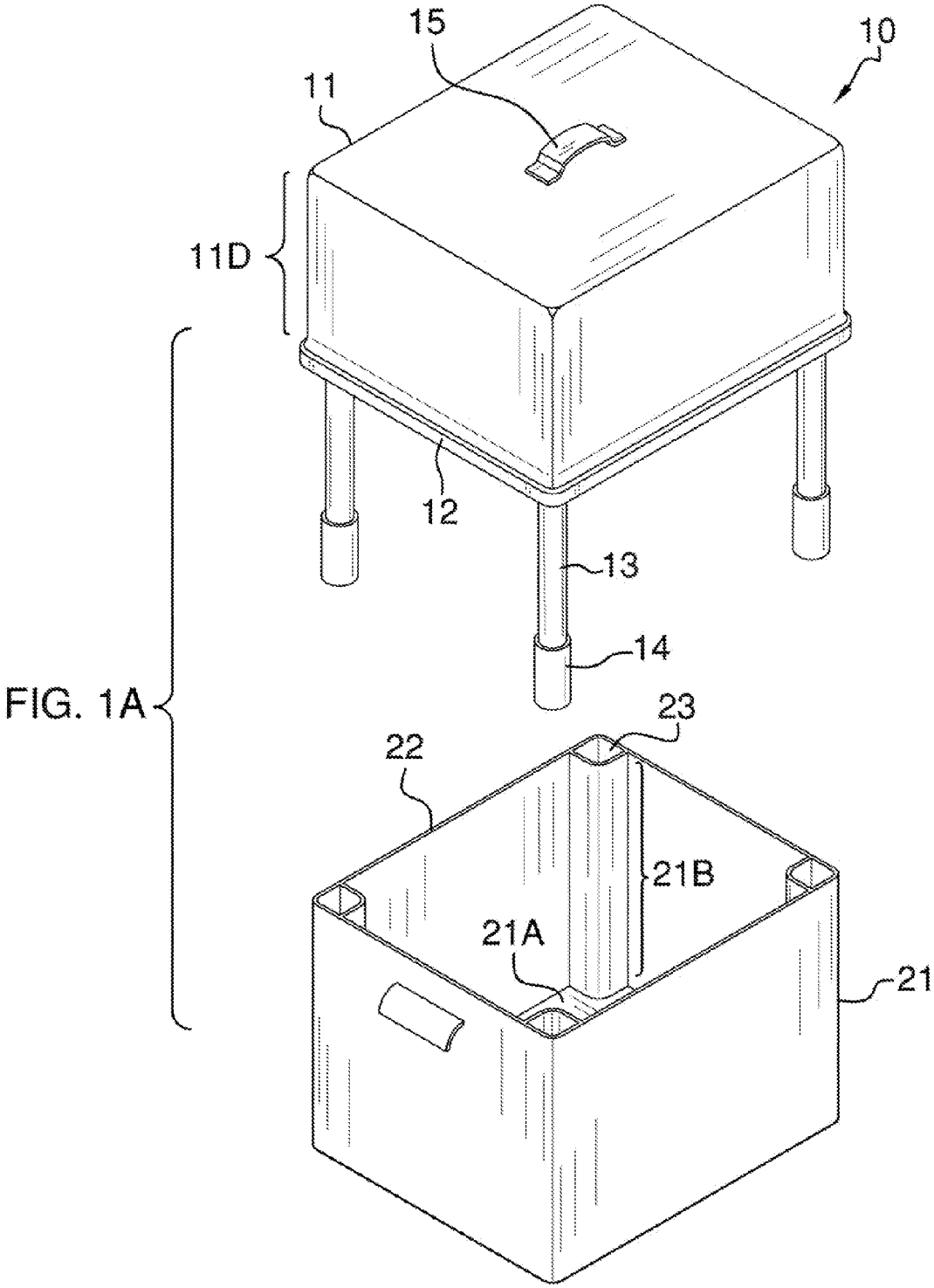
FIG. 1A illustrates a front, isometric view of the recycle bin cover system in an exploded view wherein the cover is aligned above the recycle bin, which features the leg receivers.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A recycle bin cover system 10 (hereinafter invention) includes a top 11 and a bin 21.

The top 11 is designed to be secured atop said bin 21. The top 11 includes a lip 12 that runs along a bottom periphery of said top 11 that corresponds with a rim 22 of the bin 21. The top 11 has sides of length 11D that add consider volume to the bin 21.

A top inner surface 11A of the top 11 is where a plurality of legs 13 extend downwardly. The legs 13 extend below the lip 12. The legs 13 are of hollow construction and have a cap 14 that screws onto a bottom end 13A of each leg 13. The cap has internal threading 14A that corresponds with external threading 13B located adjacent the bottom end 13A.

The cap 14 screws onto the corresponding leg 13 in order to seal a cavity 13C. The cavity 13C is designed to store weight materials 31 such as pebbles or sand therein so as to add weight to the legs 13 and to the top 11 as a whole.

The top 11 also features a handle 15 located on a top surface of said top 11. The handle 15 enables the top 11 to be lifted off of or from the bin 21.

Referring to FIGS. 1A, 2, 3, and 5, the bin 21 has located at each interior, corner a leg receiver 23. The leg receivers 23 are to be engaged by the legs 13 and the respective cap 14. The leg receivers 23 perform several functions: (1) to further secure the top 11 to the bin 21, and (2) to aid in pushing the lid 11 fully down onto the bin 21. Failure to include the leg receivers 23, may make it difficult to fully lower the lid 11 onto the bin 21 as the bin 21 may be filled with recyclables or other items, which may impede full travel of the legs 13 down to a bottom surface 21A of the bin 21. The leg receivers 23 may form a square shaped opening or a circular opening that extends a height 21B of the bin 21.

The bin 21 may also include handles 124 located on an exterior surface of the bin 21. The bin 21 may also include drainage holes 24 on a bottom surface of the bin 21, which enable fluids to escape from the bottom of the bin 21.

Figure 1B:
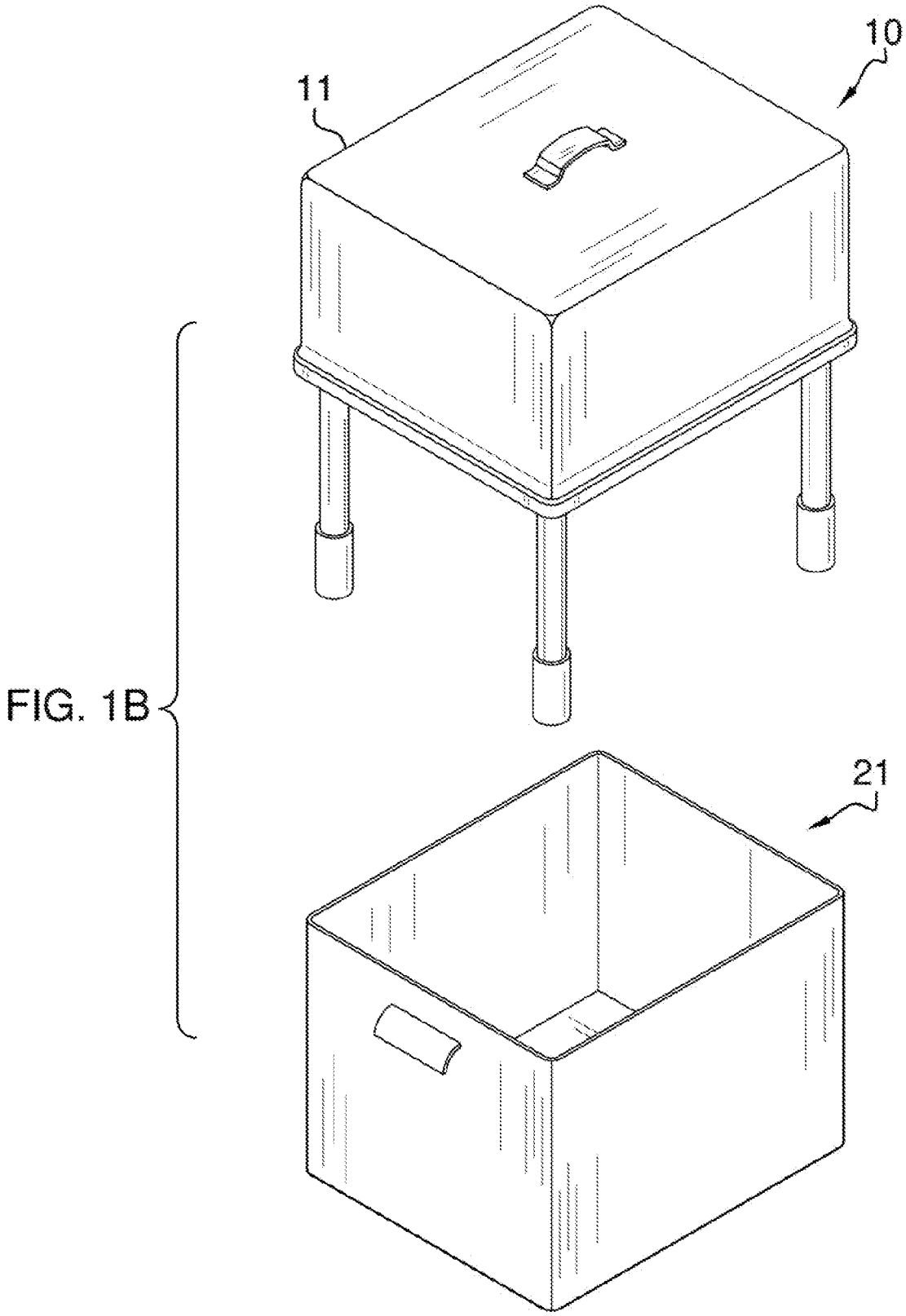
FIG. 1B illustrates a front, isometric view of the recycle bin cover system in an exploded view wherein the bin does not feature the leg receivers.
Figure 2:
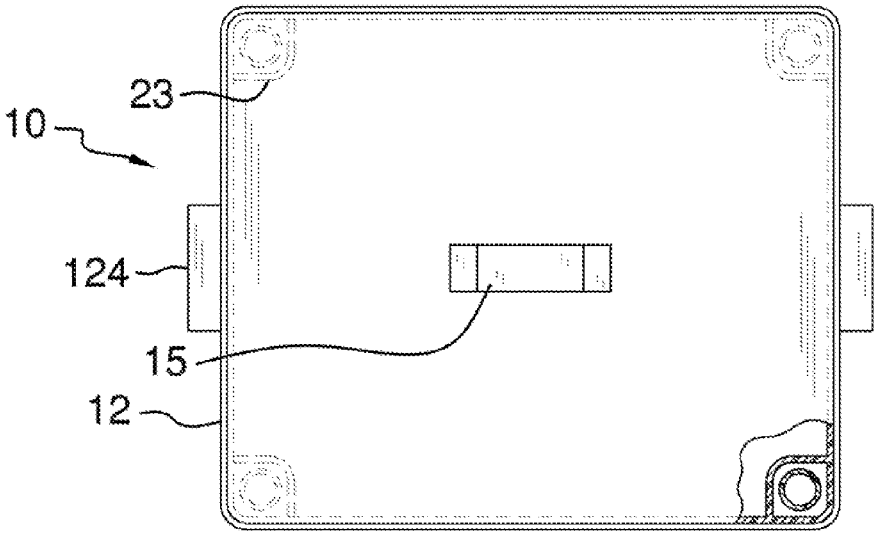
FIG. 2 illustrates a top view with a cutaway of the recycle bin cover system and depicting the inter-relation of the legs of the cover confined within the leg receivers.
Figure 3:
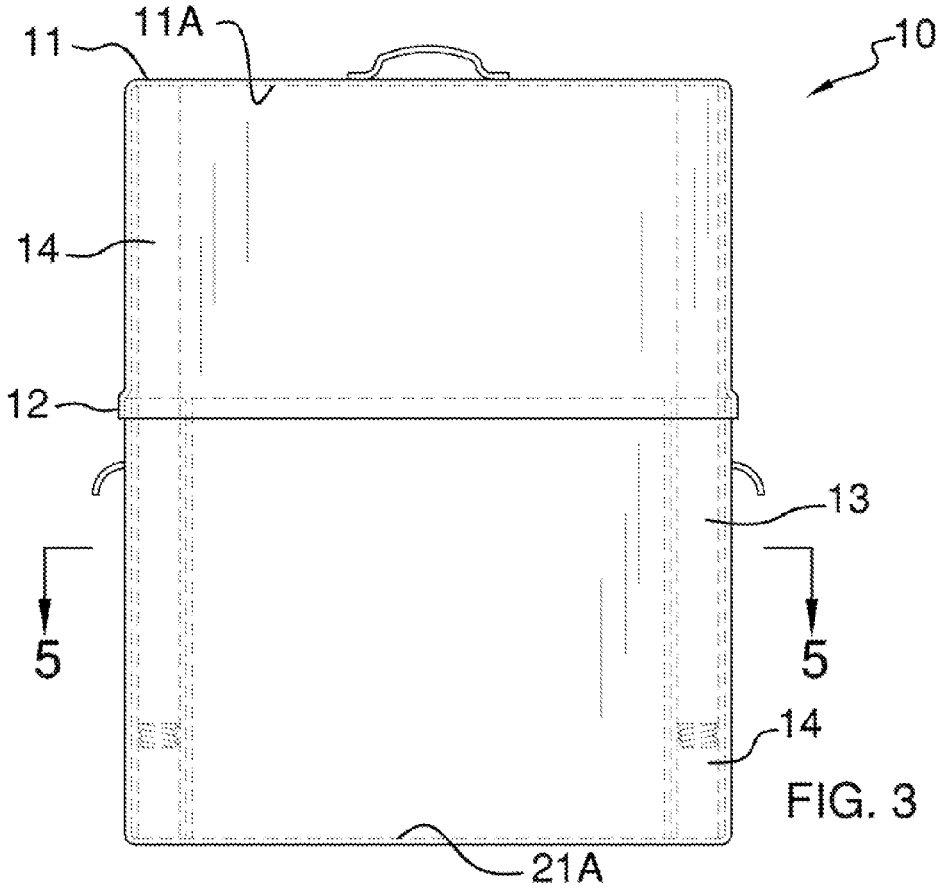
FIG. 3 illustrates a side view of the recycle bin cover system wherein the legs of the cover and the leg receivers of the bin are depicted in dashed lines.
Figure 4:
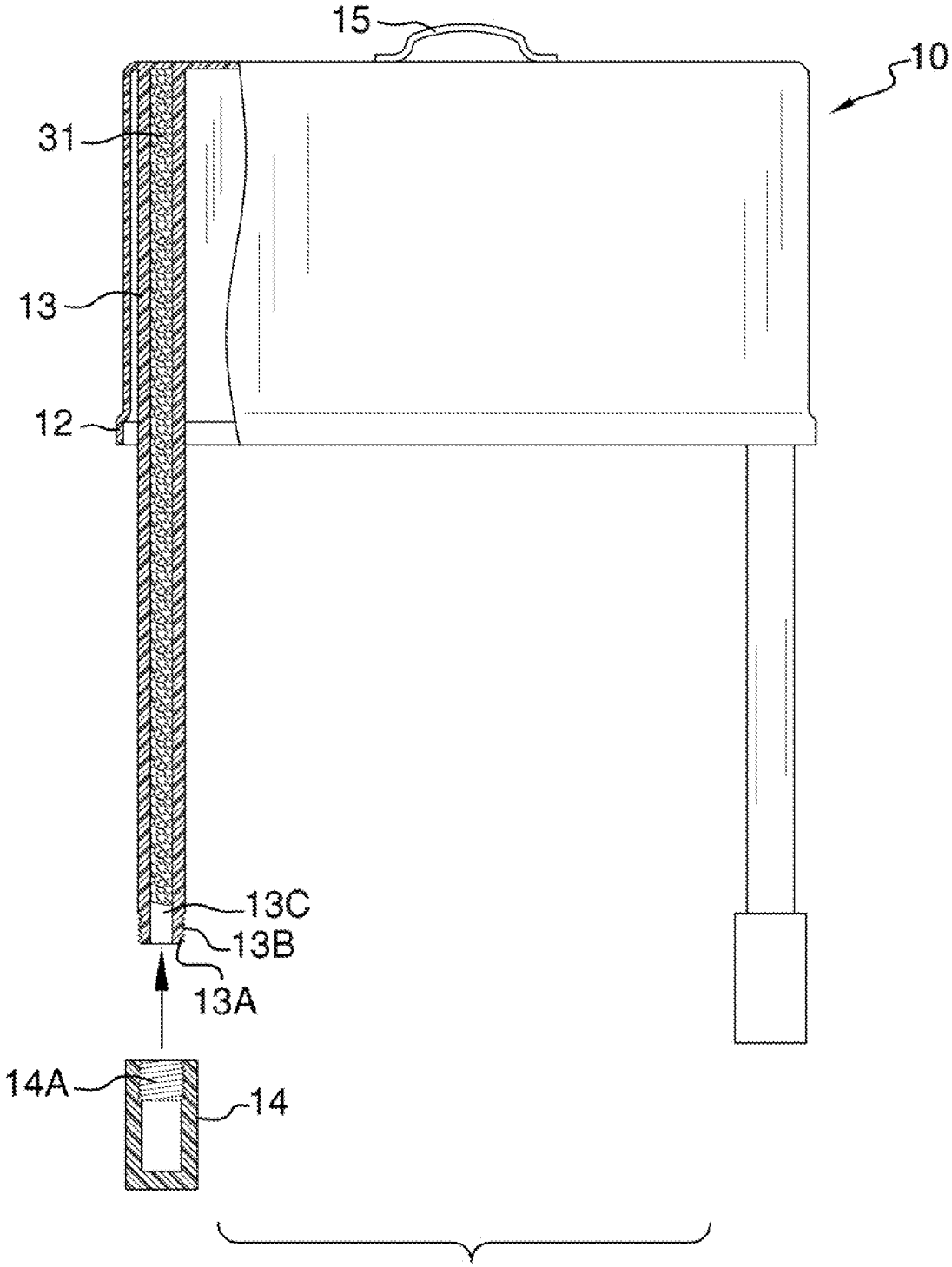
FIG. 4 illustrates a side view of the cover of the recycle bin cover system and depicting the attachment of a cap upon a leg via threading and further depicting pebbles filled within the hollow cavity of the respective leg.
Figure 5:
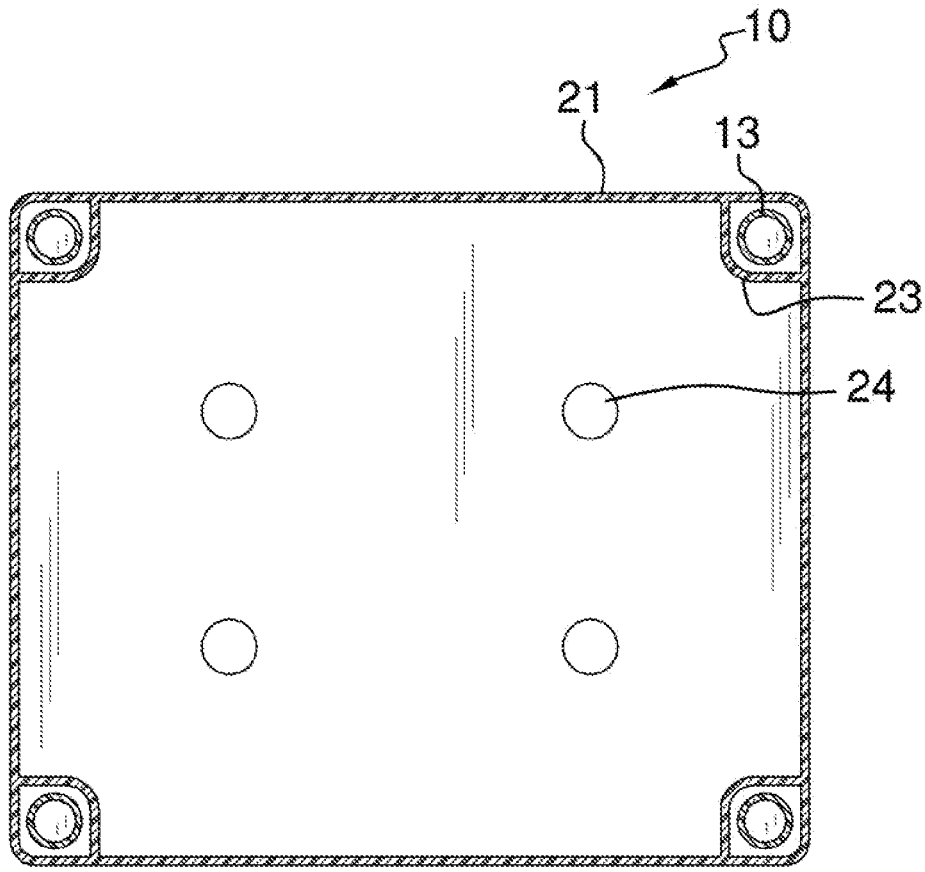
FIG. 5 illustrates a cross-sectional view of the recycle bin cover system along line 5-5 in FIG. 3 and depicting the drainage holes located in the bin as well as the inter-relationship between the legs and leg receivers.

Referring to FIG. 1B, the invention 10 has a standard bin 21 that does not include the leg receivers 23 as described above. The embodiment of the invention 10 depicted in FIG. 1B is designed to show that the invention 10 may be adapted for use with existing recycle bins that are not outfitted with the leg receivers 23. Accordingly, the embodiment depicted in FIG. 1B may be more cumbersome to fully lower the top 11 down atop the base 21.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

I claim:

1. A bin covering system comprising:

a top that has a plurality of legs extending downwardly from under said top that engage along an interior of a bin;

wherein the top increases a volume of the bin and prevents contents of said bin from blowing away;

wherein the top includes a lip that runs a bottom periphery of said top and secures said top to a rim of said bin;

wherein the bin includes a plurality of leg receivers along an interior of said bin; wherein said leg receivers correspond with the legs of the top;

wherein the leg receivers are of hollow construction and enable the legs to fully descend down a height of the bin in order to enable a lip of the top to secure upon a rim of the bin.

2. The bin cover system as described in claim 1 wherein the legs are of hollow construction and include an opening along a bottom that is enclosed via a cap.

3. The bin cover system as described in claim 2 wherein the cap forms a cavity that may be filled with a weighty material to add weight to the top.

4. The bin cover system as described in claim 1 wherein the top includes a handle for using in lifting and lowering said top to and from said bin.

5. The bin cover system as described in claim 1 wherein the bin includes a plurality of openings along a bottom surface of the bin to enable fluids to escape from below said bin.

6. A bin covering system comprising:

a top that has a plurality of legs extending downwardly from under said top that engage along an interior of a bin;

wherein the legs extend from a top, inner surface of the top down a distance beyond a lip of the top;

wherein the top increases a volume of the bin and prevents contents of said bin from blowing away;

wherein the top includes a lip that runs a bottom periphery of said top and secures said top to a rim of said bin; wherein the bin includes a plurality of leg receivers along an interior of said bin; wherein said leg receivers correspond with the legs of the top wherein the leg receivers are of hollow construction and enable the legs to fully descend down a height of the bin in order to enable the lip of the top to secure upon a rim of the bin.

7. The bin cover system as described in claim 6 wherein the legs are of hollow construction and include an opening along a bottom that is enclosed via a cap.

8. The bin cover system as described in claim 7 wherein the cap forms a cavity that may be filled with a weighty material to add weight to the top.

9. The bin cover system as described in claim 8 wherein the weighty material comprises sand or pebbles.

10. The bin cover system as described in claim 6 wherein the top includes a handle for using in lifting and lowering said top to and from said bin.

11. The bin cover system as described in claim 6 wherein the bin includes a plurality of openings along a bottom surface of the bin to enable fluids to escape from below said bin.

12. A bin covering system comprising:

a top that has a plurality of legs extending downwardly from under said top that engage along an interior of an existing bin;

wherein the legs are of hollow construction and include an opening along a bottom that is enclosed via a cap;

wherein the cap forms a cavity that may be filled with a weighty material to add weight to the top;

wherein the legs extend from a top, inner surface of the top down a distance beyond a lip of the top;

wherein the top includes a lip that runs a bottom periphery of said top and secures said top to a rim of said bin;

wherein the top includes a handle for using in lifting and lowering said top to and from said bin;

wherein the top increases a volume of the bin and prevents contents of said bin from blowing away.

13. The bin cover system as described in claim 12 wherein the weighty material comprises sand or pebbles.

14. The bin cover system as described in claim 12 wherein the bin includes a plurality of leg receivers along an interior of said bin; wherein said leg receivers correspond with the legs of the top; wherein the leg receivers are of hollow construction and enable the legs to fully descend down a height of the bin in order to enable the lip of the top to secure upon the rim of the bin.

* * * * *